US008382451B2

(12) United States Patent
Fukano et al.

(10) Patent No.: US 8,382,451 B2
(45) Date of Patent: Feb. 26, 2013

(54) PUMP APPARATUS

(75) Inventors: Yoshihiro Fukano, Moriya (JP); Takamitsu Suzuki, Joso (JP)

(73) Assignee: SMC Kabushiki Kaisha, Tokyo (JP)

( * ) Notice: Subject to any disclaimer, the term of this patent is extended or adjusted under 35 U.S.C. 154(b) by 240 days.

(21) Appl. No.: 12/575,185

(22) Filed: Oct. 7, 2009

(65) Prior Publication Data

US 2010/0272589 A1 Oct. 28, 2010

(30) Foreign Application Priority Data

Apr. 28, 2009 (JP) ..... 2009-108592

(51) Int. Cl.
*F04B 35/02* (2006.01)
*F04B 9/08* (2006.01)

(52) U.S. Cl. ..... 417/383; 417/389; 417/390

(58) Field of Classification Search ..... 417/383, 417/389, 382, 379, 390, 384, 398, 410.1, 417/415–419, 560
See application file for complete search history.

(56) References Cited

U.S. PATENT DOCUMENTS

| | | | | |
|---|---|---|---|---|
| 2,675,758 | A | 4/1954 | Hughes | |
| 4,634,430 | A | 1/1987 | Polaschegg | |
| 4,950,134 | A * | 8/1990 | Bailey et al. | 417/383 |
| 5,649,910 | A * | 7/1997 | Kriesel et al. | 604/133 |
| 6,250,502 | B1 * | 6/2001 | Cote et al. | 222/1 |
| 6,481,980 | B1 * | 11/2002 | Vandlik et al. | 417/313 |
| 6,663,359 | B2 * | 12/2003 | Gray | 417/383 |
| 6,723,062 | B1 * | 4/2004 | Westberg et al. | 604/4.01 |
| 6,759,007 | B1 * | 7/2004 | Westberg et al. | 422/44 |
| 6,905,314 | B2 * | 6/2005 | Danby | 417/53 |
| 6,941,853 | B2 | 9/2005 | Hembree | |
| 7,029,245 | B2 * | 4/2006 | Maianti et al. | 417/395 |
| 7,695,423 | B2 * | 4/2010 | Robinson et al. | 494/43 |
| 7,717,682 | B2 * | 5/2010 | Orr | 417/395 |
| 8,038,640 | B2 * | 10/2011 | Orr | 604/6.11 |

(Continued)

FOREIGN PATENT DOCUMENTS

| | | |
|---|---|---|
| DE | 199 03 052 A1 | 8/2000 |
| JP | 64-8368 | 1/1989 |

(Continued)

OTHER PUBLICATIONS

Office Action issued on Feb. 1, 2011 in Japanese Patent Application No. 2009-108592 (with Partial English Translation).

(Continued)

*Primary Examiner* — Devon Kramer
*Assistant Examiner* — Ryan Gatzemeyer
(74) *Attorney, Agent, or Firm* — Oblon, Spivak, McClelland, Maier & Neustadt, L.L.P.

(57) ABSTRACT

In a constant rate discharge pump, a rotary drive source is disposed on an end of a housing, and on the other end of the housing, a pump head is provided, having a pump chamber into which a fluid is drawn, and a filling chamber filled with an indirect medium. Further, a displacement mechanism having a displacement nut which is displaced under a driving action of the rotary drive source is disposed in the interior of the housing. A bellows is interposed between a tubular body connected to the displacement nut and a first block of the pump head, wherein the interior of the bellows also is filled with the indirect medium, which is made up from an incompressible fluid. Furthermore, a flexible diaphragm is disposed in the pump head between the fluid and the indirect medium.

8 Claims, 9 Drawing Sheets

U.S. PATENT DOCUMENTS

| | | | | |
|---|---|---|---|---|
| 8,042,563 | B2 * | 10/2011 | Wilt et al. | 137/100 |
| 2004/0076526 | A1 * | 4/2004 | Fukano et al. | 417/212 |
| 2006/0027606 | A1 * | 2/2006 | Fukano et al. | 222/334 |
| 2006/0251533 | A1 * | 11/2006 | Nighy et al. | 417/479 |
| 2007/0077156 | A1 * | 4/2007 | Orr | 417/395 |
| 2008/0260549 | A1 | 10/2008 | Yajima | |

FOREIGN PATENT DOCUMENTS

| | | |
|---|---|---|
| JP | 5-296149 | 11/1993 |
| JP | 2006-266250 | 10/2006 |
| JP | 2008-038837 | 2/2008 |

OTHER PUBLICATIONS

Office Action issued Jul. 10, 2012 in Japanese Patent Application No. 2009-108592 filed Apr. 28, 2009 (with English Translation).

Office Action issued Nov. 8, 2011, in Japanese Patent Application No. 2009-108592 with English translation of pertinent portion.

Office Action issued Jul. 31, 2012 in German Application No. 102009048721.2, filed Oct. 8, 2009. (With an English Translation).

* cited by examiner

PUMP APPARATUS

CROSS-REFERENCE TO RELATED APPLICATION

This application is based upon and claims the benefit of priority from Patent Application No. 2009-108592 filed on Apr. 28, 2009, in the Japan Patent Office, of which the contents are incorporated herein by reference.

BACKGROUND OF THE INVENTION

1. Field of the Invention

The present invention relates to a pump apparatus, which is capable of discharging a fluid continuously at a constant rate through a displacement mechanism under a driving operation of a driving element.

2. Description of the Related Art

Heretofore, a constant rate ejection pump has been adopted for supplying a medicinal, a coating, a cleaning solution or the like at a constant rate in a manufacturing apparatus of a semiconductor or the like, a coating apparatus, a medical device, etc.

The present applicant, as disclosed in Japanese Laid-Open Patent Publication No. 2006-029302, has proposed a pump apparatus in which a pump chamber is formed in the interior of a body having a suction port through which a fluid is drawn in and a discharge port through which the fluid is discharged. A piston is displaced along a first chamber inside the body under the action of a pilot pressure. Together therewith, an indirect medium formed from an incompressible fluid is pressed by the piston, and a diaphragm, which is disposed alongside the indirect medium, is flexed, whereupon the fluid filled in the pump chamber is pressed on by the diaphragm and discharged.

SUMMARY OF THE INVENTION

A general object of the present invention is to provide a pump apparatus, which is capable of preventing entry of air bubbles into an indirect medium, for thereby discharging a fluid more accurately at a constant rate.

The pump apparatus of the present invention is characterized by a body having a port through which a fluid is drawn in and discharged, and a pump chamber communicating with the port, a displacement mechanism having a displacement body disposed in an interior portion of the body and which is displaceable along an axial direction, a driving member disposed at an end of the body and which displaces the displacement mechanism along the axial direction upon being energized electrically, a bellows interposed between the displacement body and the body, an indirect medium made up from an incompressible fluid and which is filled in a filling chamber of the body and in the bellows that communicates with the filling chamber, and a diaphragm disposed in the interior of the body between the pump chamber and the indirect medium, wherein the diaphragm discharges the fluid inside the pump chamber upon displacement of the displacement mechanism.

According to the present invention, the displacement mechanism including the displacement body is disposed in the interior of a body having a port, and by driving the driving section, which is installed on an end of the body, upon supply of electrical energy thereto, the displacement body is displaced along the axial direction. Together therewith, a bellows is interposed between the displacement body and the body, and an indirect medium made up from an incompressible fluid is filled inside the bellows and a filling chamber of the body. Additionally, the bellows is compressed by displacement of the displacement body, so that the indirect medium filled in the interior thereof is transferred to the side of the filling chamber, and by pressing upon the diaphragm, which is disposed in the filling chamber, fluid that is drawn into the pump chamber adjacent to the diaphragm is discharged through the port.

Consequently, in a pump apparatus, in which a driving section is capable of being driven when energized electrically for thereby displacing a displacement body, an indirect medium is filled inside a bellows, and since the indirect medium is retained in a fluid-tight condition, ingress of air into the indirect medium can be prevented, and deterioration of the accuracy at which the fluid is discharged due to ingress of air can be prevented. As a result, the fluid can be discharged highly accurately at a constant rate.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
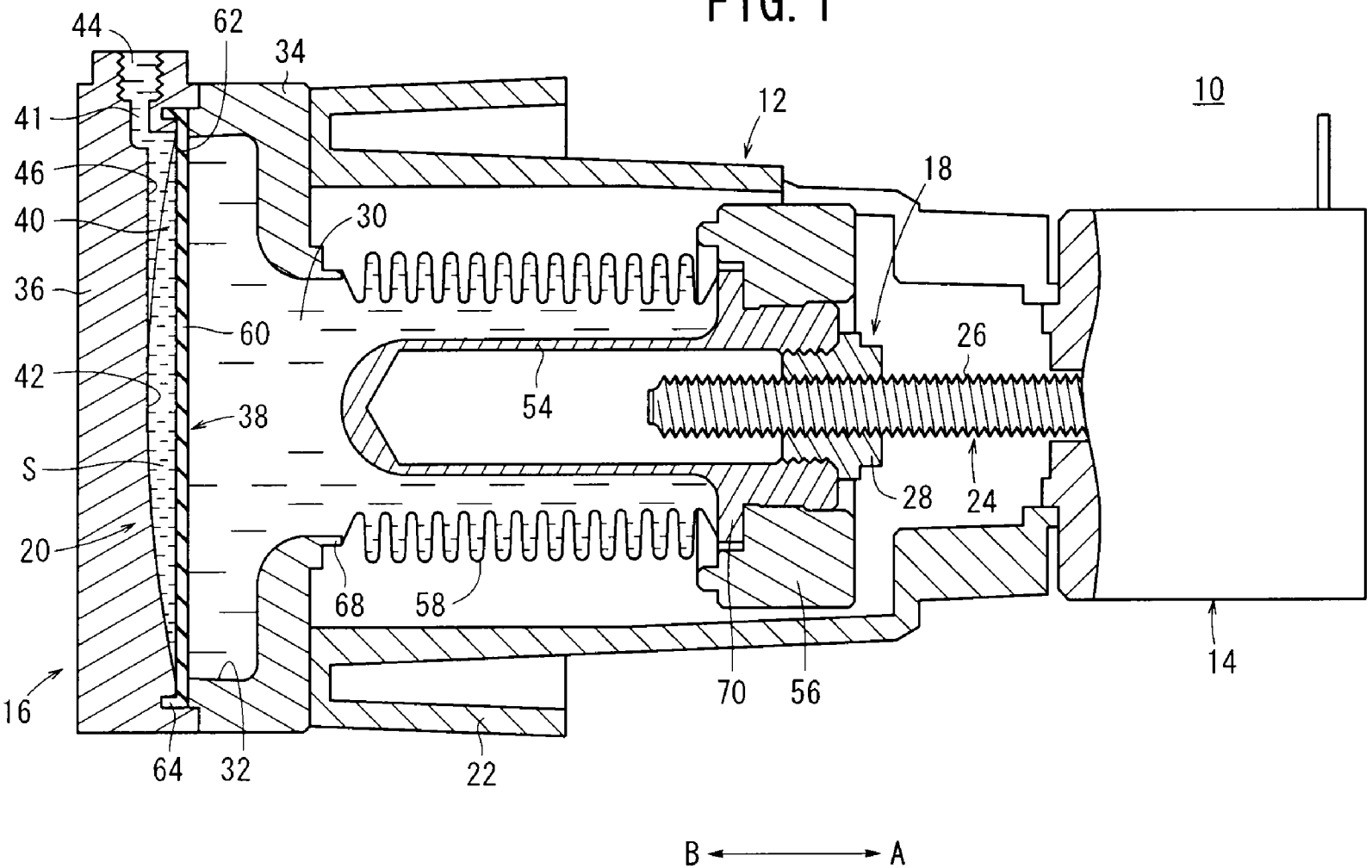
FIG. 1 is an overall cross sectional view of a constant rate discharge pump according to a first embodiment of the present invention.

In FIG. 1, reference numeral 10 indicates a constant rate discharge pump (pump apparatus) according to a first embodiment of the present invention.

The constant rate discharge pump 10, as shown in FIGS. 1 to 6, includes a hollow housing (body) 12, a rotary drive source (driving member) 14 disposed on an end of the housing 12, a pump head (body) 16 connected to the other end of the housing 12, a displacement mechanism 18 that is displaced in an axial direction along the interior of the housing 12 under a driving action of the rotary drive source 14, and a discharging mechanism 20 for discharging a fluid S by displacement of the displacement mechanism 18.

The housing 12 is formed from a metallic material, for example, with a portion of the rotary drive source 14 being inserted in and connected to an open end of the housing 12. Otherwise, at the other end of the housing 12, after being bent substantially at a right angle and expanded in a radial outward direction, a folded back portion 22 is formed, which is folded again at a right angle and extends at a predetermined length toward the side of the one end portion (in the direction of arrow A). Stated otherwise, the folded back portion 22 is formed in an annular shape along a circumferential direction of the housing 12, with roughly a U-shape in cross section.

Figure 2:
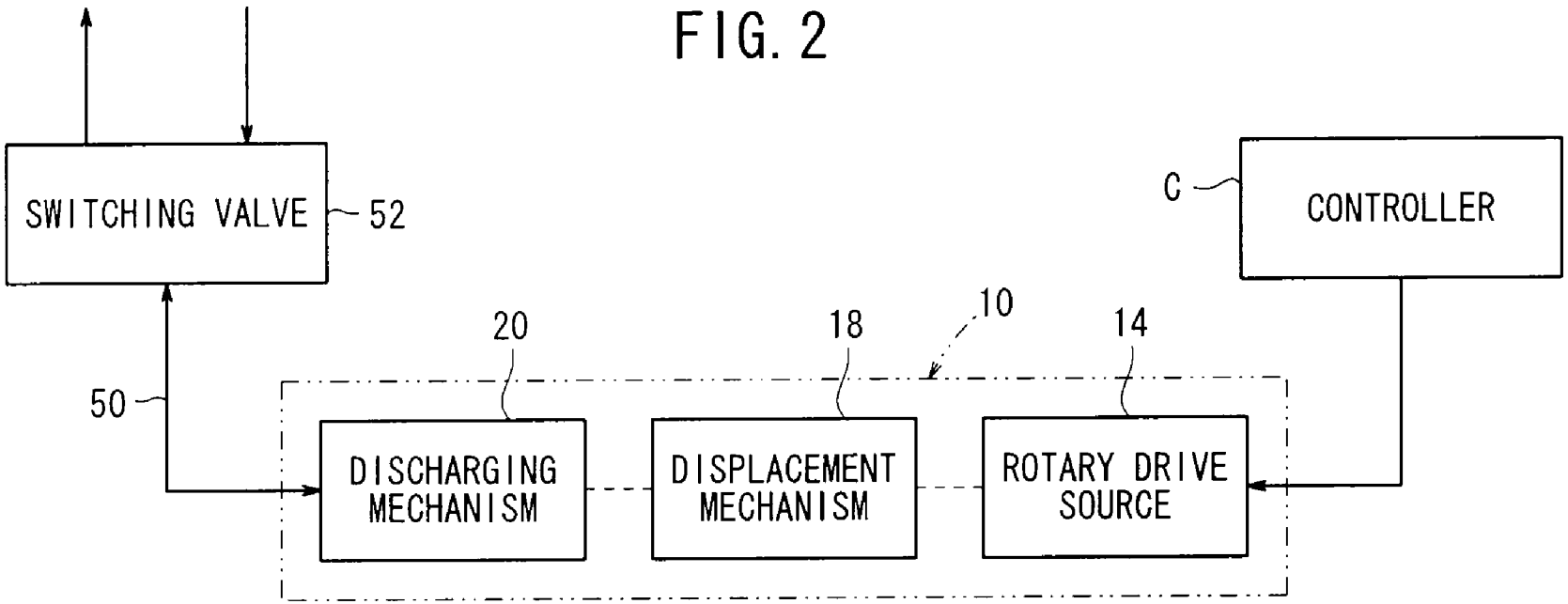
FIG. 2 is an outline schematic view of a pumping unit, in which the constant rate discharge pump shown in FIG. 1 is used.

The rotary drive source 14 is formed, for example, from a stepping motor and is equipped with a drive axis (shaft) 24, which is rotated based on an output signal from a controller C (see FIG. 2). The drive shaft 24 is disposed on the axis of the rotary drive source 14 such that, in a condition where the rotary drive source 14 is connected to one end of the housing 12, the drive shaft 24 is inserted for a predetermined length into the interior of the housing 12. Further, screw threads 26 are engraved on the outer circumferential surface of the drive shaft 24, and a displacement nut (displacement body) 28 constituting the displacement mechanism 18 is screw-engaged with the drive shaft 24.

The pump head 16 is installed on the open other end of the housing 12, and comprises a first block 34 having a filling chamber 32 therein, which is filled with an indirect medium 30 formed from an incompressible fluid such as oil or the like, for example, and a second block 36 connected to an end surface of the first block 34, which closes and seals the filling chamber 32. A diaphragm 38 that constitutes a later-described discharging mechanism 20 is sandwiched and gripped between the first block 34 and the second block 36.

The filling chamber 32 is widest on a side of the second block 36, while it is narrower on a side of the housing 12 in a stepwise fashion with respect to the side of the second block 36.

Further, a pump chamber 40 is formed in the second block 36, which faces toward the filling chamber 32 of the first block 34. The pump chamber 40 includes a spherical surface 42, which is recessed with respect to an end surface of the second block 36 in a substantially spherical shape in a direction separating away from the first block 34, and communicates through a communication passage 41 with the fluid port 44, which is disposed on an outer side surface of the second block 36.

Figure 3:
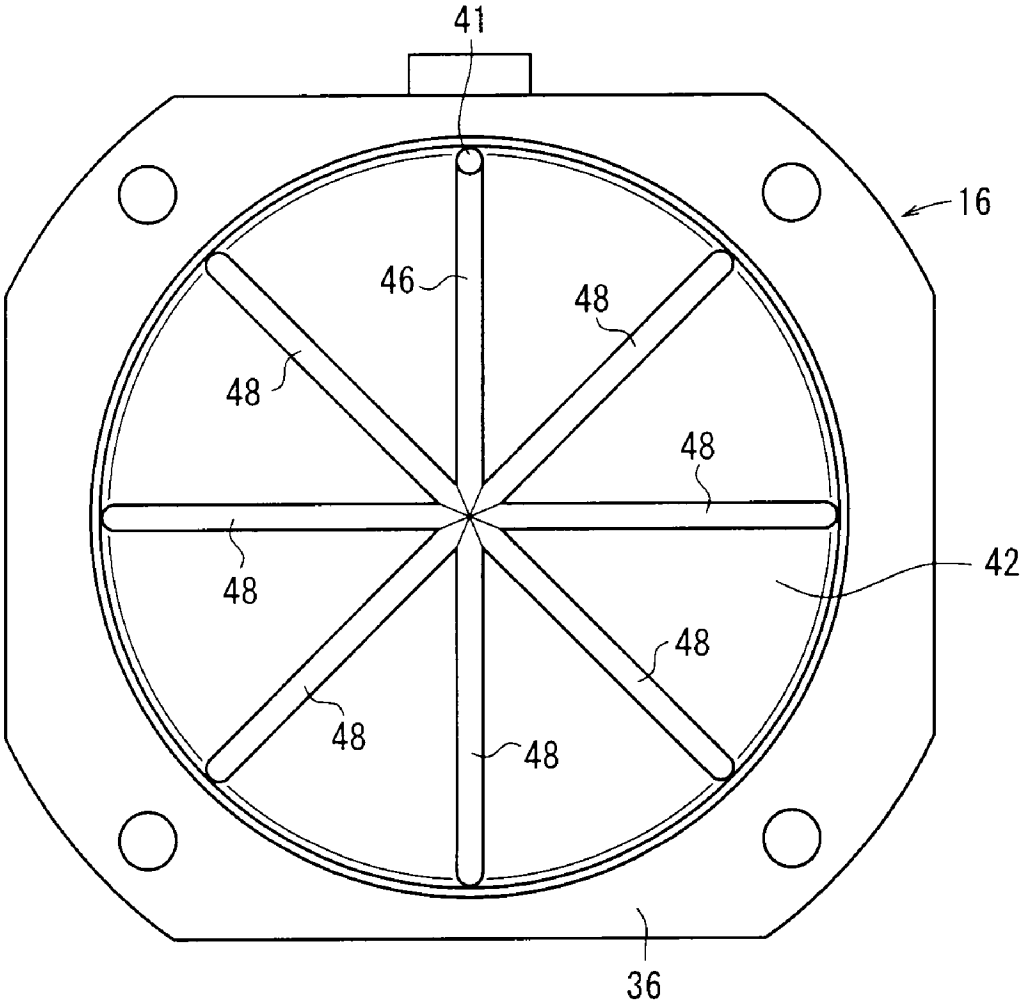
FIG. 3 is a front view of a pump head of the constant rate discharge pump shown in FIG. 1.
Figure 4:
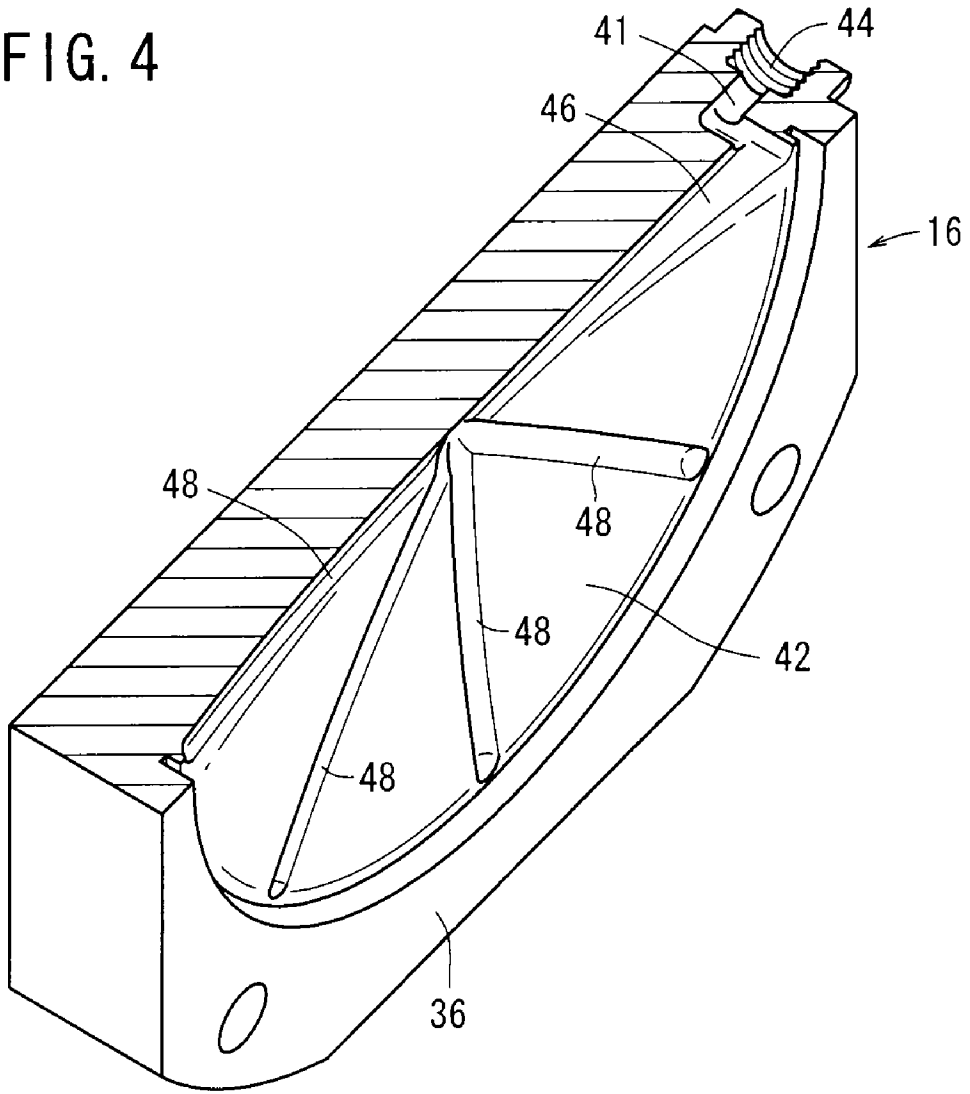
FIG. 4 is a cross sectional perspective view of the pump head shown in FIG. 3.
Figure 5:
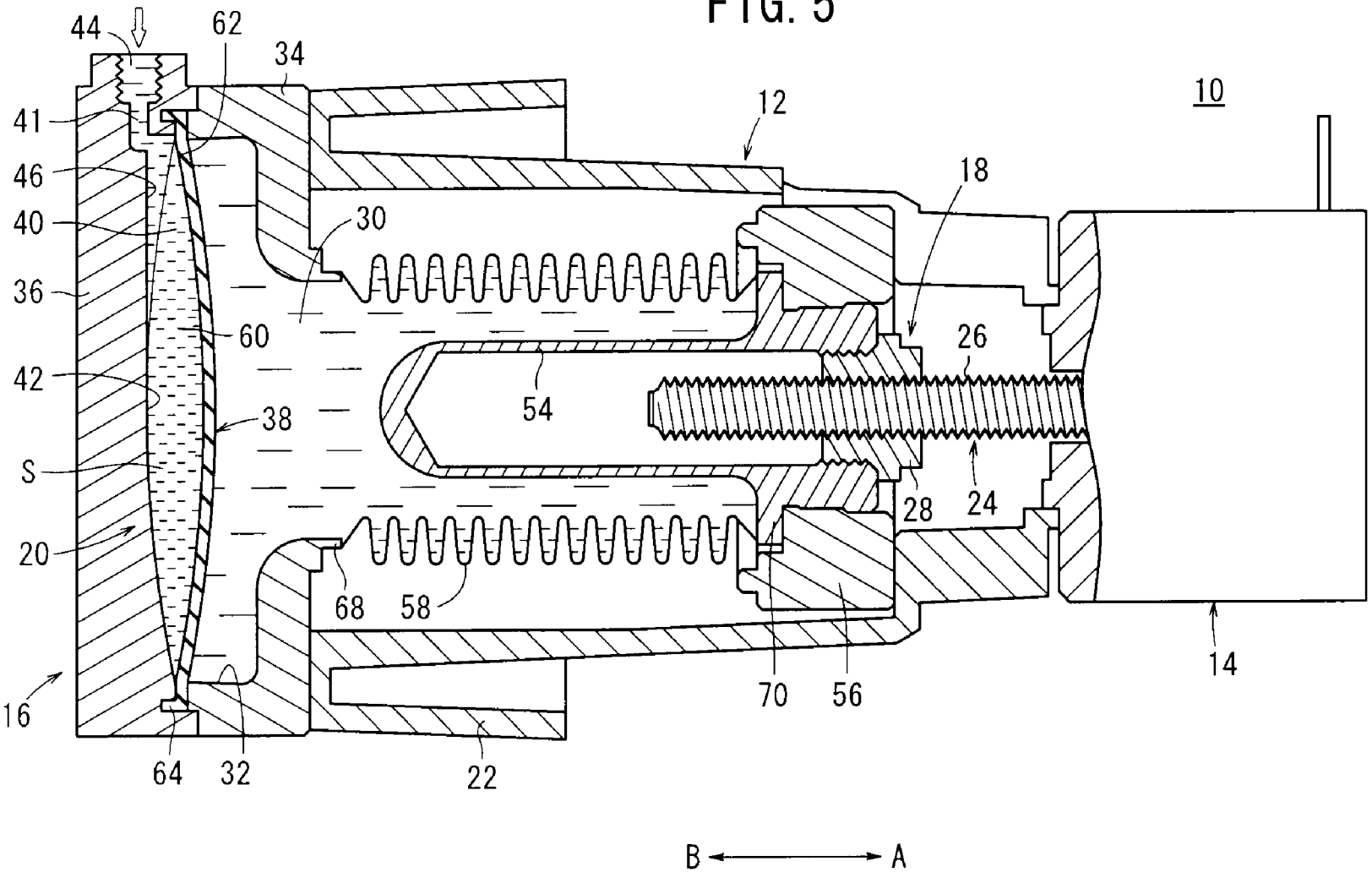
FIG. 5 is an overall cross sectional view showing a condition in which a fluid is drawn into a pump chamber, in the constant rate discharge pump shown in FIG. 1.

The spherical surface 42 is formed such that a center portion of the second block 36, more specifically, a location on the axis of the constant rate discharge pump 10, is recessed most deeply. Further, as shown in FIGS. 3 and 4, a first groove 46, which extends in a straight line toward the communication passage 41 from the center of the spherical surface 42, and a plurality of (e.g., seven) second grooves 48, which extend in a radiating manner in a radial outward direction from the center, are formed on the inner wall surface of the spherical surface 42.

The first and second grooves 46, 48 are formed so as to be recessed at a predetermined depth with respect to the face of the spherical surface 42, and together therewith, the first groove 46 is formed at a given depth substantially parallel with the end surface of the second block 36, whereas the second grooves 48 are formed at a fixed depth with respect to the face of the spherical surface 42 and are separated from each other mutually at a predetermined angle.

Stated otherwise, the first groove 46 is formed so that the depth thereof with respect to the face of the spherical surface 42 grows progressively deeper toward the side of the communication passage 41, whereas the second grooves 48 extend at a constant depth in a radial outward direction of the spherical surface 42.

On the other hand, the fluid port 44 is formed on an outer side surface of the second block 36, to which a tube 50 is connected via a non-illustrated connecting plug. In addition, a switching valve 52, such as a 3-port valve or the like, is connected to the tube 50. A non-illustrated semiconductor coating liquid supply source, for example, is connected to the switching valve 52, and together therewith, a non-illustrated coating liquid drop-applying apparatus is connected to the switching valve 52, so as to enable mutual switching therebetween.

More specifically, in the case that a fluid S is supplied with respect to the fluid port 44, under a switching action of the switching valve 52, the coating liquid supply source is placed in communication with the fluid port 44. On the other hand, in the case that the fluid S is to be discharged from the fluid port 44 to the coating liquid drop-applying apparatus, under a switching action of the switching valve 52, the fluid port 44 is placed in communication with the coating liquid drop-applying apparatus.

Stated otherwise, the switching valve 52 is switched to supply the fluid S to the fluid port 44 from the coating liquid supply source, as well as to discharge the fluid S from the pump chamber 40 to the coating liquid drop-applying apparatus (not shown).

The displacement mechanism 18 includes the displacement nut 28 disposed in the interior of the housing 12 and screw-engaged with the drive shaft 24, a bottomed cylindrical shaped tubular body 54, which is screw engaged with an end of the displacement nut 28 and disposed so as to cover a portion of the displacement nut 28 and the drive shaft 24, and a block body 56 disposed on an outer circumferential side of the tubular body 54. Additionally, by rotation of the drive shaft 24 under a driving action of the rotary drive source 14, the displacement nut 28 is displaced together with the tubular body 54 and the block body 56 along the axial direction (the direction of arrows A and B) inside the housing 12.

The discharging mechanism 20 is equipped with the diaphragm 38 disposed between the first block 34 and the second block 36, and a bellows 58 interposed between the end of the first block 34 and the displacement mechanism 18. The interior of the bellows 58 is connected in communication with the filling chamber 32.

The diaphragm 38 is made, for example, from an elastic material such as a resin material, rubber, or the like, and has a main body portion 60, and a circumferential edge portion 62, which is formed in a radial outward direction of the main body portion 60, and is thinner than the main body portion 60. The circumferential edge portion 62 is sandwiched and gripped between the first block 34 and the second block 36 in the pump head 16.

Stated otherwise, the main body portion 60 of the diaphragm 38 is formed to be thicker than the circumferential edge portion 62. Further, the circumferential edge portion 62 is equipped with a projection 64, which is bent toward the side of the second block 36. The projection 64 is inserted into a concave groove disposed in an end surface of the second block 36.

The bellows 58 is formed from a metallic material, for example, with a tubular shape, the outer circumferential surface of which is folded in a concave/convex manner in radial directions along the axial direction thereof so as to be a bellows-like shape. In addition, one end of the bellows 58 is disposed in the center of the first block 34 and is affixed to an opening 68 that communicates with the filling chamber 32, whereas the other end of the bellows 58 is affixed with respect to a flange 70 of the tubular body 54. The bellows 58, for example, is affixed by welding or the like with respect to the first block 34 and the tubular body 54.

Additionally, because the interior of the bellows 58 is connected so as to communicate with the filling chamber 32 of the first block 34, the indirect medium 30, which is filled inside the filling chamber 32, also fills the interior of the bellows 58. More specifically, the diaphragm 38, the filling chamber 32 and the bellows 58 collectively make up a space in which the indirect medium 30 is filled.

The constant rate discharge pump 10 according to the first embodiment of the invention is constructed basically as described above. Next, operations and effects of the invention shall be explained. Further, the condition shown in FIG. 5 indicates an initial position, in which a predetermined amount of fluid S already is drawn into the pump chamber 40, the diaphragm 38 is recessed in a concave shape on the side of the rotary drive source 14, and the displacement nut 28 is moved toward the side of the rotary drive source 14 (in the direction of arrow A).

First, a control signal is output from a controller C (see FIG. 2) with respect to the rotary drive source 14, whereupon the drive shaft 24 is rotated due to the rotary drive source 14 being driven rotatably, and the displacement nut 28 is moved toward the side of the pump head 16 (in the direction of arrow B). Together therewith, the tubular body 54 and the block body 56 are moved integrally with the displacement nut 28 toward the side of the pump head 16 (in the direction of arrow B).

Figure 6:
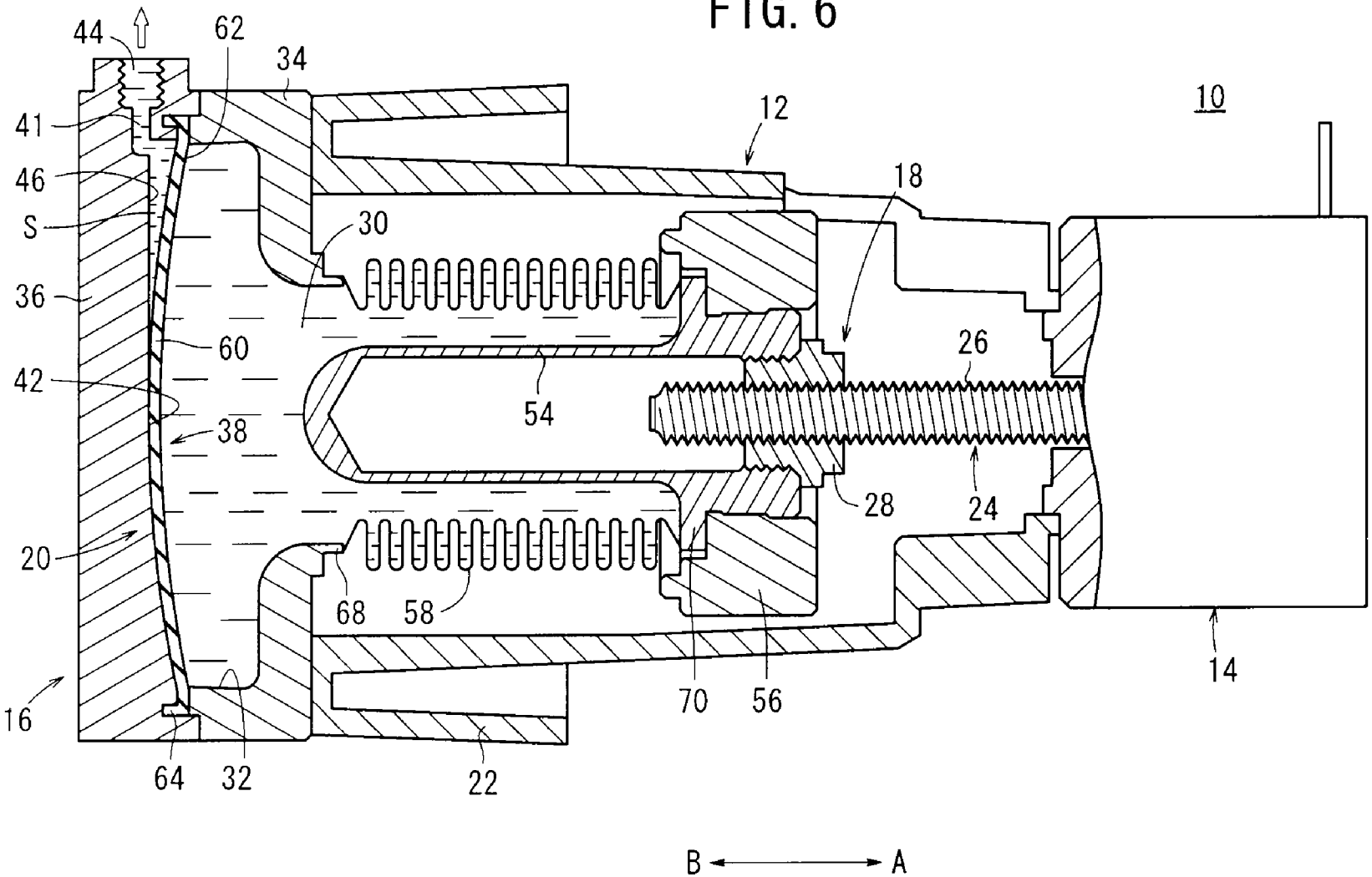
FIG. 6 is an overall cross sectional view showing a condition in which a fluid is discharged from the pump chamber, in the constant rate discharge pump shown in FIG. 5.

Additionally, as a result of the other end portion of the bellows 58 being pressed toward the side of the pump head 16 (in the direction of arrow B) by the tubular body 54 and the block body 56, the indirect medium 30 filled in the interior thereof is pressed toward the side of the filling chamber 32 (in the direction of arrow B) and is introduced into the filling chamber 32, whereby the diaphragm 38 is flexed due to being pressed toward the side of the pump chamber 40 (see FIG. 6).

Owing thereto, the diaphragm 38 is deformed in abutment against the spherical surface 42 of the pump chamber 40, which is formed in a spherical shape, and the fluid S that was drawn into the interior of the pump chamber 40 is guided to the side of the communication passage 41 through the first groove 46, and is discharged to the exterior at a constant rate from the fluid port 44.

As a result, due to the displacement of the displacement mechanism 18 being transmitted to the diaphragm 38 through the indirect medium 30 which is formed from an incompressible fluid, the displacement amount of the displacement nut 28, the tubular body 54 and the block body 56 is set in a proportional relationship with the flow rate (discharge rate) of the fluid S, which is pressed by the diaphragm 38 and discharged from the pump chamber 40 through the fluid port 44.

The fluid S in the interior of the pump chamber 40 is discharged to the coating liquid drop-applying apparatus under a switching action of the switching valve 52, which is connected through the tube 50 to the fluid port 44, so that normally a constant rate of the fluid S (e.g., a coating liquid) is dripped onto a semiconductor wafer. More specifically, the flow rate of the fluid S discharged from the fluid port 44 corresponds to the displacement amount of the displacement mechanism 18, so that flow rate control of the fluid S can be continuously carried out highly accurately at a constant rate.

In the forgoing manner, according to the first embodiment, the bellows 58 is interposed between the tubular body 54 and the pump head 16 in the displacement mechanism 18, and the filling chamber 32 filled with the indirect medium 30 and the interior of the bellows 58 are placed in communication. Consequently, the bellows 58 is pressed by the displacement mechanism 18, whereby the indirect medium 30 is capable of being pressed toward the side of the diaphragm 38.

More specifically, ingress of air into the indirect medium 30, which was of concern in the conventional constant rate discharge pump, can be prevented, along with preventing deterioration in the accuracy at which the fluid S is discharged, due to the ingress of air into the indirect medium 30. As a result, the fluid S can be discharged at a constant rate with high accuracy.

Stated otherwise, by interposing the bellows 58 between the tubular body 54 that makes up the displacement mechanism 18 and the first block 34 of the pump head 16 and causing the indirect medium 30 to be filled therein, ingress of air from the outside to the interior of the bellows 58 is prevented, and a fluidtight condition of the indirect medium 30 in the bellows 58 can be maintained reliably.

Further, in the second block 36 that constitutes the pump chamber 40, because the first and second radial grooves 46, 48 are formed in the spherical surface 42 facing the diaphragm 38, when the fluid S inside the pump chamber 40 is discharged under a pressing action by the diaphragm 38, the fluid S can be made to flow along the first and second grooves 46, 48. As a result, the fluid S can be discharged accurately and efficiently to the fluid port 44 from the pump chamber 40.

Figure 7:
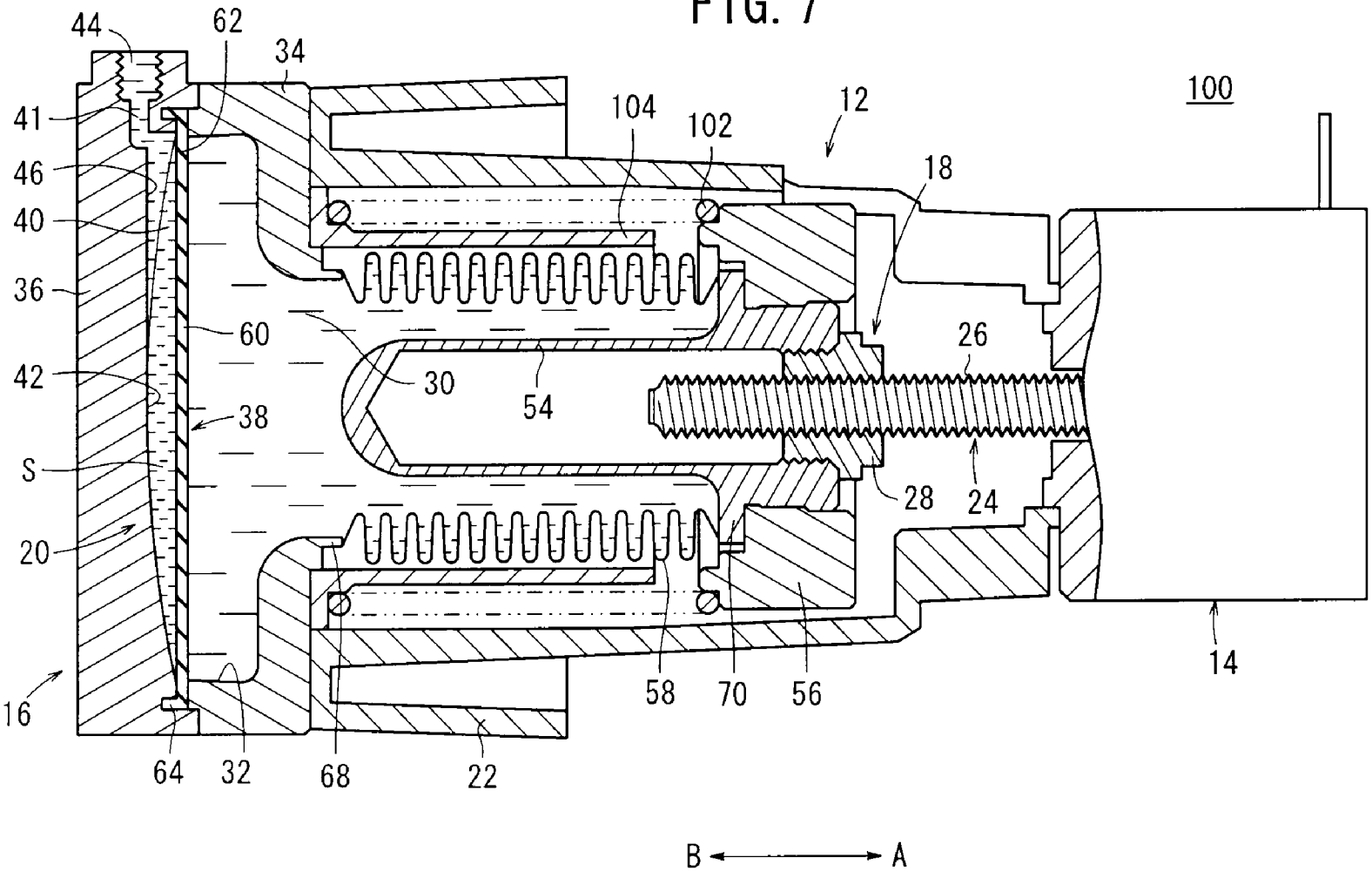
FIG. 7 is an overall cross sectional view of a constant rate discharge pump according to a second embodiment of the present invention.

Next, a constant rate discharge pump 100 according to a second embodiment is shown in FIG. 7. Structural elements thereof, which are the same as those of the constant rate discharge pump 10 according to the aforementioned first embodiment, are designated by the same reference characters, and detailed descriptions of such features have been omitted.

The constant rate discharge pump 100 according to the second embodiment differs from the constant rate discharge pump 10 according to the aforementioned first embodiment in that a spring 102 is disposed in the interior of the housing 12.

As shown in FIG. 7, the constant rate discharge pump 100 is equipped with a cylindrical spring guide 104 in the interior of the housing 12. The spring guide 104 is affixed to an end surface of the first block 34 and is disposed so as to cover the outer circumferential side of the bellows 58.

The spring 102 is made up from a coil spring, for example, disposed on the outer circumferential side of the spring guide 104, such that one end thereof is mounted on an end of the spring guide 104 affixed to the first block 34, whereas the other end is mounted on an end of the block body 56 that constitutes the displacement mechanism 18. Additionally, an elastic force of the spring 102 urges the displacement mechanism 18 including the block body 56 in a direction (the direction of arrow A) away from the pump head 16.

With the second embodiment configured in the foregoing manner, when a rotary force of the rotary drive source 14 is converted into linear motion by the displacement mechanism 18 along the axial direction (the direction of arrows A and B), a concern exists in that backlash may be generated between the drive shaft 24 and the displacement nut 28, which is screw-engaged on the drive shaft 24. However, due to the presence of the spring 102, since a structure is provided whereby the block body 56 is pressed along the axial direction, the occurrence of backlash can be prevented. As a result, the displacement nut 28 connected to the block body 56 can be displaced along the axial direction (the direction of arrows A and B) highly accurately corresponding to the rotation amount of the rotary drive source 14, and compared to the constant rate discharge pump 10 of the first embodiment, the fluid S can be discharged at a constant rate with even greater accuracy.

Figure 8:
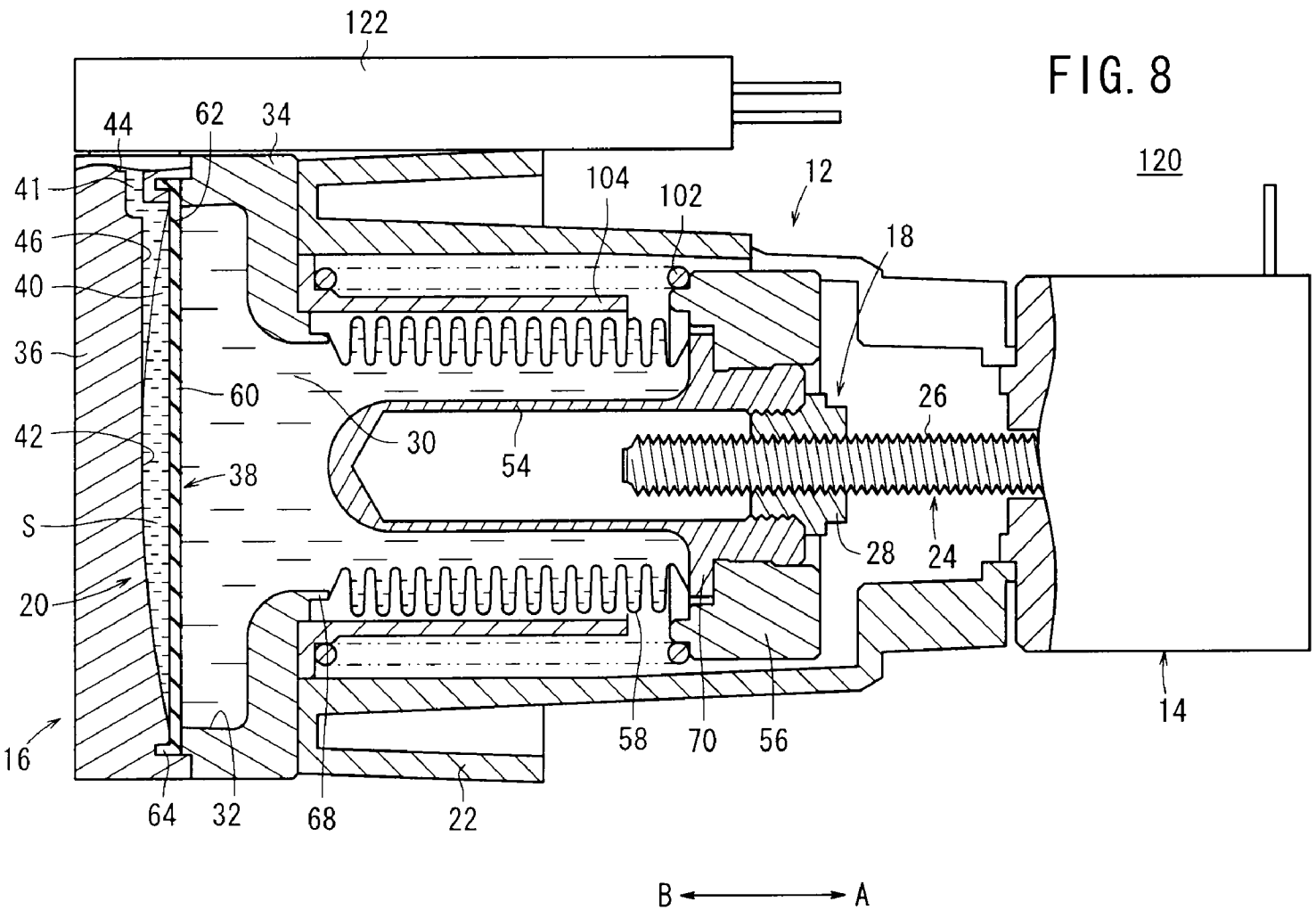
FIG. 8 is an overall cross sectional view of a constant rate discharge pump according to a third embodiment of the present invention.

Next, a constant rate discharge pump 120 according to a third embodiment is shown in FIG. 8. Structural elements thereof, which are the same as those of the constant rate discharge pumps 10, 100 according to the aforementioned first and second embodiments, are designated by the same reference characters, and detailed descriptions of such features have been omitted.

The constant rate discharge pump 120 according to the third embodiment differs from the constant rate discharge pumps 10, 100 according to the aforementioned first and second embodiments in that a switching valve 122 is attached directly with respect to the fluid port 44 of the pump head 16.

With the third embodiment configured in the foregoing manner, since the switching valve 122, which is capable of switching between sucking and discharge states of the fluid S, is disposed directly with respect to the fluid port 44, a tube interconnecting the switching valve 122 and the pump head 16 can be rendered unnecessary. Also, since the switching valve 122 is disposed adjacent to the constant rate discharge pump 120, compared to a case in which the switching valve 122 were disposed at a position separated from the constant rate discharge pump 120, maintenance thereon can be facilitated.

Further, in the case that a suction port for drawing in the fluid and a discharge port for discharging the fluid are each provided separately as in the conventional technique, it is necessary for a check valve to be provided for regulating flows of the fluid, respectively. Therefore, the number of parts is increased, and the piping arrangement for connecting the check valve becomes complex, leading to a concern that maintenance thereon is troublesome and difficult to perform. By contrast, with the constant rate discharge pump 120 of the present invention, piping connections are simplified by rendering the tube unnecessary, the number of parts and costs are reduced, and maintenance of the constant rate discharge pump 120 can be facilitated.

Further, since the constant rate discharge pump 120 of the present invention does not require tubes or the like for connecting the switching valve 122, it is possible to prevent deterioration in the accuracy at which the fluid S is discharged. Thus, compared to the case in which the switching valve 122 were connected by tubes or the like, the fluid S is discharged highly accurately at a desired amount.

Figure 9:
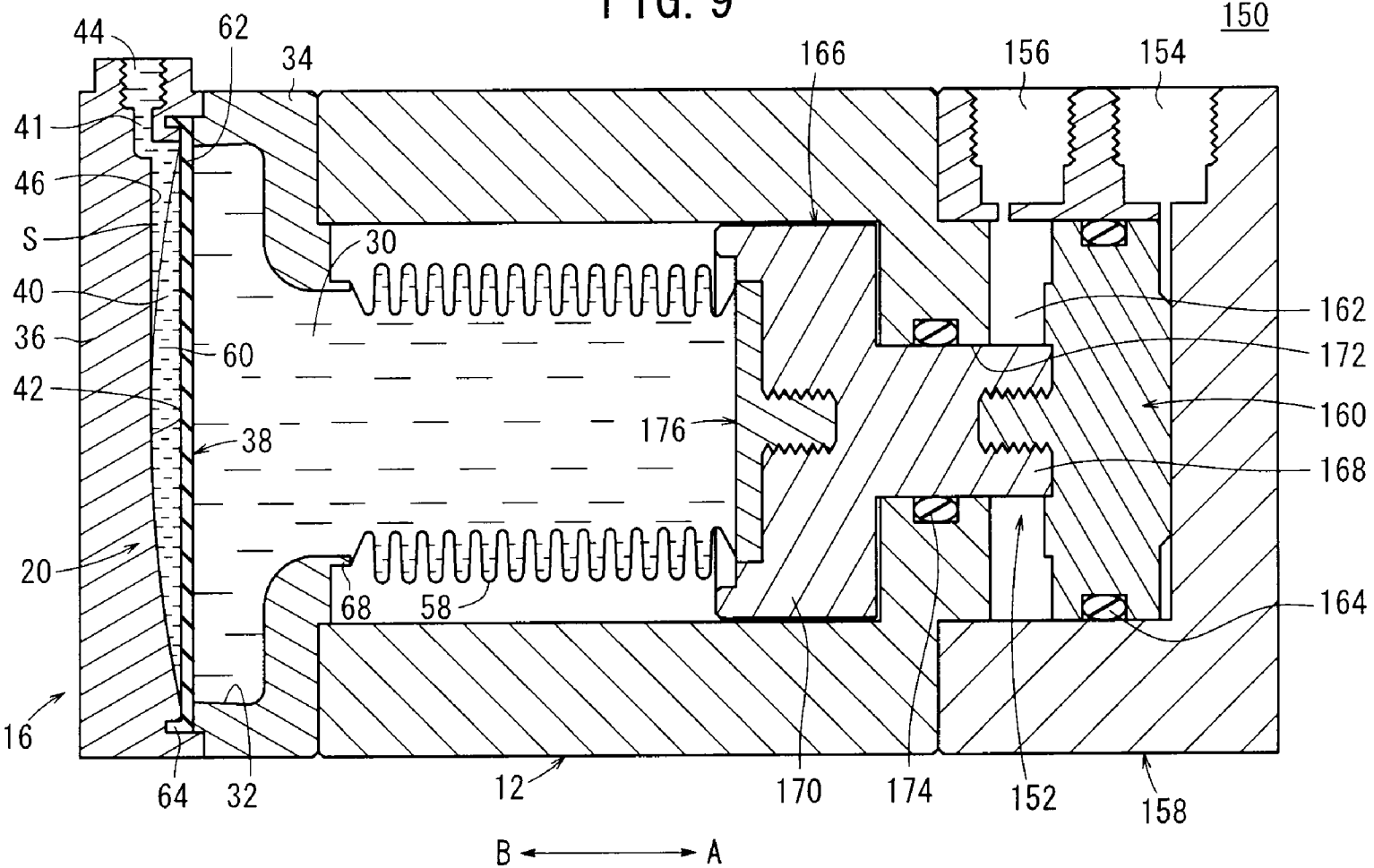
FIG. 9 is an overall cross sectional view of a constant rate discharge pump according to a fourth embodiment of the present invention.

Lastly, a constant rate discharge pump 150 according to a fourth embodiment is shown in FIG. 9. Structural elements thereof, which are the same as those of the constant rate discharge pumps 10, 100, 120 according to the aforementioned first, second and third embodiments, are designated by the same reference characters, and detailed descriptions of such features have been omitted.

The constant rate discharge pump 150 according to the fourth embodiment differs from the constant rate discharge pumps 10, 100 according to the aforementioned first and second embodiments in that, instead of being displaced by an electrically driven rotary drive source 14, the displacement mechanism 152 is displaced by supply of a pressure fluid.

As shown in FIG. 9, in the constant rate discharge pump 150, a port block (body) 158 having first and second pilot ports 154, 156 is installed on an end of the housing 12. In the interior of the port block 158, a piston 160 is disposed, which is displaceable along the axial direction.

The port block 158 is formed with substantially a U-shape in cross section, and is mounted so as to cover the end portion of the housing 12. First and second pilot ports 154, 156 that communicate with the exterior are formed in the port block 158, which are separated a predetermined distance along the axial direction (the direction of arrows A and B). Further, a piston chamber 162 is formed in the interior of the port block 158, which is supplied with a pilot pressure through the first and second pilot ports 154, 156, and a piston 160 is disposed in the piston chamber 162.

The piston 160 constitutes the displacement mechanism 152. A piston packing 164 is provided on the outer circumferential surface of the piston 160, in sliding contact with the inner circumferential wall of the piston chamber 162, and an adapter 166 is screw-engaged and connected to one end of the piston 160.

The adapter 166 is made up from a rod section 168 connected to the piston 160, and a base section 170, which is expanded in diameter in a radial outward direction with respect to the rod section 168, and is displaceably disposed in the interior of the housing 12. The rod section 168 is inserted through a rod hole 172 formed in the end of the housing 12, wherein the outer circumferential surface of the rod section 168 is surrounded by a rod packing 174, which is mounted in the rod hole 172.

Further, the base section 170 is disposed to face toward the bellows 58, which is provided in the housing 12, and a retaining member 176 is installed in an end thereof, which retains the other end of the bellows 58. As a result, the bellows 58 is interposed between the retaining member 176 and the first block 34 constituting the pump head 16, and the interior of the bellows 58 is filled with the indirect medium 30.

In addition, the pressure fluid is supplied to the first pilot port 154, whereby the piston 160 is pressed toward the side of the pump head 16 (in the direction of arrow B) by the pressure fluid, which is supplied to the interior of the piston chamber 162. Owing thereto, the other end of the bellows 58 is pressed toward the side of the pump head 16 (in the direction of arrow B), and by pressing of the indirect medium 30 inside the bellows 58 toward the side of the pump head 16 (in the direction of arrow B), the diaphragm 38 is pressed by the indirect medium 30 toward the pump chamber 40 and flexes. As a result, the diaphragm 38 is deformed into abutment with the spherical surface 42 of the pump chamber 40, which is formed in a spherical shape, and the fluid S that was drawn into the pump chamber 40 is guided to the side of the communication passage 41 through the first groove 46, and is discharged to the exterior at a constant rate via the fluid port 44.

In the foregoing manner, according to the fourth embodiment, the piston 160 is displaced by a pressure fluid, which is supplied to the first and second pilot ports 154, 156, and the indirect medium 30 inside the bellows 58, which is interposed between the adapter 166 and the pump head 16, is pressed toward the side of the diaphragm 38, thereby enabling the fluid S to be discharged to the exterior highly accurately from the pump chamber 40.

The pump apparatus according to the present invention is not limited to the above embodiments, but various other structures may be adopted as a matter of course without departing from the essence of the invention.

What is claimed is:

1. A pump apparatus comprising:

a body having a port through which a fluid is drawn in and discharged, and a pump chamber communicating with the port;

a displacement mechanism having a displacement body disposed in an interior portion of the body and which is displaceable along an axial direction;

a driving member disposed at an end of the body and which displaces the displacement mechanism along the axial direction upon being energized electrically;

a bellows interposed between the displacement body and the body;

an indirect medium made up from an incompressible fluid and which is filled in a filling chamber of the body and in the bellows that communicates with the filling chamber; and a diaphragm disposed in the interior of the body between the pump chamber and the indirect medium, wherein the diaphragm discharges the fluid inside the pump chamber upon displacement of the displacement mechanism, wherein the pump chamber comprises:

a concave spherical surface facing the diaphragm, wherein the port is provided at the radial periphery of the concave spherical surface, a plurality of radial grooves in the concave spherical surface, the radial grooves merging at the center of the concave spherical surface to form a common recessed portion located at the center of the concave spherical surface, wherein one of said grooves communicates with said port and entirely extends in a three dimensionally straight line from said common recessed portion to said port.

2. The pump apparatus according to claim 1, wherein the displacement mechanism comprises:

a shaft which is rotated under a driving action of the driving member; and the displacement body, which is screw-engaged with the shaft.

3. The pump apparatus according to claim 2, wherein a spring, which urges the displacement body in a direction to separate from the diaphragm, is disposed between the displacement body and the body.

4. The pump apparatus according to claim 1, wherein a switching valve is disposed in the port for switching between sucking and discharging states of the fluid to and from the port.

5. A pump apparatus comprising:

a body having a first port through which a fluid is drawn in and discharged, and a pump chamber communicating with the first port;

a driving member connected to an end of the body and having second ports to which a pilot pressure is supplied, and which displaces a piston along an axial direction upon supply of the pilot pressure thereto;

a displacement mechanism having a displacement body disposed in an interior portion of the body and which is displaceable along an axial direction upon displacement of the piston;

a bellows interposed between the displacement body and the body;

an indirect medium made up from an incompressible fluid and which is filled in a filling chamber of the body and in the bellows that communicates with the filling chamber; and a diaphragm disposed in the interior of the body between the pump chamber and the indirect medium, wherein the diaphragm discharges the fluid inside the pump chamber upon displacement of the displacement mechanism, wherein the pump chamber comprises:

a concave spherical surface facing the diaphragm, wherein the first port is provided at the radial periphery of the concave spherical surface, a plurality of radial grooves in the concave spherical surface to form a common recessed portion located at the center of the concave spherical surface, the radial grooves merging at the center of the concave spherical surface, wherein one of said grooves communicates with said first port and entirely extends in a three dimensionally straight line from said common recessed portion to said first port.

6. The pump apparatus according to claim 1, wherein all of said grooves, other than said one of said grooves, have a constant depth, and wherein the depth of said one of said grooves increases progressively and continuously for its entire length from the center of the concave spherical surface to said port.

7. The pump apparatus according to claim 5, wherein all of said grooves, other than said one of said grooves, have a constant depth, and wherein the depth of said one of said grooves increases progressively and continuously for its entire length from the center of the concave spherical surface to said first port.

8. The pump apparatus according to claim 5, wherein a switching valve is disposed in the first port for switching between sucking and discharging states of the fluid to and from the first port.

* * * * *